United States Patent [19]

Hall et al.

[11] 3,939,508

[45] Feb. 24, 1976

[54] MATTRESS AND CUSHIONING CONSTRUCTION

[75] Inventors: Ervin T. Hall; Miles E. Talbert; James R. Walsh; Max E. Hinkle, all of High Point, N.C.

[73] Assignee: Thomasville Products, Inc., High Point, N.C.

[22] Filed: Jan. 8, 1975

[21] Appl. No.: 539,524

[52] U.S. Cl. ..... 5/345 R; 5/355; 5/361 B; 297/DIG. 1

[51] Int. Cl.[2] ..... A47C 27/08; A47C 27/22

[58] Field of Search ..... 297/DIG. 1; 5/345, 351, 5/355, 361 R, 361 B, DIG. 2

[56] References Cited

UNITED STATES PATENTS

| | | | |
|---|---|---|---|
| 3,027,573 | 4/1962 | Bell, Jr. | 5/355 |
| 3,118,153 | 1/1964 | Hood | 5/345 R |
| 3,521,311 | 7/1970 | Cohen | 5/345 R |
| 3,846,857 | 11/1974 | Weinstock | 5/345 R |

*Primary Examiner*—Casmir A. Nunberg

[57] ABSTRACT

A laminated mattress construction having outer layers of relatively soft, virgin foam material and an inner layer or core made of firmer reground, bonded foam. The thickness and firmness of the core are varied in relation to that of the outer layers to achieve a mattress having an overall compression modulus of at least 3. Individually the outer layers are so constructed as to exhibit a 25% ILD range of 10–45 lbs. and the core is so constructed as to exhibit a 25% ILD range of 20–80 lbs. The mattress is further constructed in horizontally juxtaposed sections with one section having firmness characteristics which differ from another section. Finally a removable mattress covering is provided which permits removal of the foam core and separate cleaning or replacement thereof.

3 Claims, 3 Drawing Figures

MATTRESS AND CUSHIONING CONSTRUCTION

BACKGROUND

It is known in the prior art to construct cushions or mattresses with layers of a resilient foam rubber or man-made polymeric material. For example, U.S. Pat. No. 3,118,153 to Hood discloses the use of a laminated foam construction with the inner and outer layers of different foam densities to help the cushion conform to and retain the shape of its covering without a special molding process. In U.S. Pat. No. 2,878,153 to Hacklander the use of multiple layers of foam is taught with the flow tendencies controlled by means of applying compression and tension to selected layers. Other patents, such as Shecter, U.S. Pat. No. 3,047,888, disclose laminar construction of cushions using various materials to control the firmness of the cushion.

A desirable characteristic of cushion is an initial softness upon depression followed by subsequent firmness on further depression. However, to the knowledge of the inventors there has been no attempt to engineer a cushion or mattress construction that achieves such a characteristic in an all foam cushion by selectively varying the relative thickness and firmness of the layers. A mattress or cushion having a compression modulus of at least 3 and in the range of 3–8 will exhibit comfort, but excellent support. The "compression modulus" as used herein is a measure of the aforesaid initial softness and subsequent firmness characteristic, and is defined by the ratio of the load weight necessary to compress a foam sample 65 percent of its thickness compared with the load weight necessary to compress the same foam sample 25 percent of its thickness.

In addition, to the knowledge of the inventors, there has been no attempt to engineer a laminated mattress construction that includes horizontally juxtaposed, multiple sections of varying firmness to provide one mattress that is equally comfortable to two people.

SUMMARY OF THE INVENTION

The present invention then is directed to such a mattress which exhibits a compression modulus of at least 3 in order to achieve the combination of comfort and firmness. In this regard the mattress is constructed by bonding together coextensive outer layers of soft, virgin foam and an inner layer of firmer reground and bonded virgin foam. According to this invention, two parameters may be varied to achieve the desired compression modulus. First the thickness of the inner layer may be varied within the range of 1–5 times the thickness of the outer layer. Secondly, the relative firmnesses of the inner and outer layers may be adjusted. The outer layer should have a 25 percent ILD range of 10–45 lbs. per 50 sq. in. The inner layer should have a 25 percent ILD range of 20–80 lbs. per 50 sq. in. As used herein, the "25 percent range" is a measure of firmness defined as "indent load depression" and is the range of force or weight applied through a 50 sq. in. plate which will compress a precrushed 20×20×4 inch specimen 25 percent of its thickness.

The cushion materials used may be any of the resilient cellular materials, such as urethane foam or other foams known to those skilled in the art. These materials are available in a variety of textures from high to low density and from very low to very high degrees of firmness. The virgin foam is preferably used in sheet form, while the inner layer is reground and bonded granules, chips, flakes or shreds.

A further novel feature of mattresses constructed according to the present invention is that they are peculiarly adapted for sectionalized construction in which two horizontally adjacent inner layers are covered by a common outer layer, each section exhibiting a different compression modulus from the other. The combination of sections may be easily varied to comply with the desires of each customer. This sectionalized construction permits two people who share the same bed to have a mattress of a firmness suitable to their individual desires. The overall size of the sections are preferably equal and they are joined to form a single mattress, however, the inner layer of each section is varied in firmness or thickness to accomplish the desired compression modulus.

According to conventional construction methods, upon completion of the cushioning structure, it has heretofore been the practice to secure the ticking or covering to the mattress. In the present invention the mattress is covered with a removable ticking to facilitate removal for cleaning and/or replacement.

It is therefore an object of the invention to provide a cushion construction combining characteristics of initial softness and subsequent firmness.

It is another object of the present invention to provide a mattress construction wherein the compression modulus is easily controlled and maintained at a level above 3.

It is also an object of the present invention to provide a mattress having horizontally adjacent sections each having a different compression modulus.

It is still a further object of the invention to provide a mattress with a removable ticking.

Futher objects and embodiments of the invention will be readily apparent to those skilled in the art after reading the following specification and detailed description of the drawings wherein.

Figure 1:
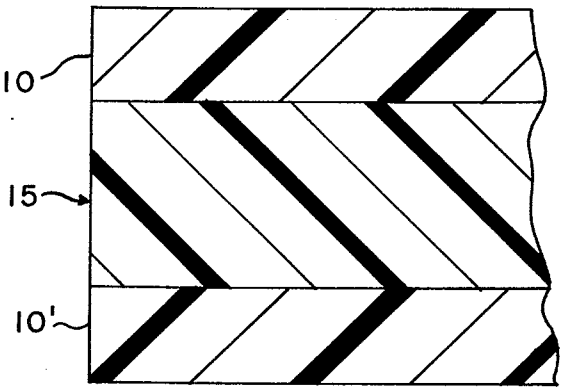
FIG. 1 is a partial sectional view of the cushion construction according to the present invention.

The preferred embodiment of the present invention, as illustrated in FIG. 1, in general is a multi-layer cushion construction C wherein outer layers 10, 10′ are formed from a relatively low soft, resilient cellular material and the core or inner layer 15 is formed from a firmer resilient cellular material. The characteristics of thickness and firmness of outer layers 10, 10′ and core 15 are so selected and combined as to provide a cushion having an overall compression modulus in the range of 3–8. Such a compression modulus insures the desired results of a cushion or mattress that exhibits initial softness upon depression followed by increased firmness upon further depression.

As far as the individual layers are concerned, outer layers 10, 10′ are preferably formed of a relatively soft foam material such as polyurethane or any of the other known elastomeric foams. These layers 10, 10′, in order to achieve the initial softness desired, are selected from a 25 percent ILD range of 10–45 lbs. and are bonded to a core layer 15.

Turning now to core 15, the inner layer is preferably formed of a firmer foam material such as flakes, chips, shreds, etc. of scrap virgin foam, which are compressed and bound together in sheets by the use of adhesives and/or a heat compression process. The more foam compressed, the firmer the resulting sheet, and for the purpose of the instant invention the core 15 should exhibit a 25 percent ILD range of 20–80 pounds. Therefore the same type of foam may be made firmer in core 15 than in outer layers 10, 10'.

It has further been found in the present invention that, in addition to varying the relative ILD ranges, the goal of a prescribed total cushion compression modulus can also be achieved by varying the relative layer thickness between the core 15 and outer layers 10, 10'. In this regard the core 15 should vary in thickness from 1–5 times the thickness of the outer layers. It can be seen that many variations are possible by merely varying the relative thicknesses and firmnesses of the outer layers and the core layer.

A mattress constructed in accordance with the present invention has been tested for recovery and durability by a professional testing laboratory. It demonstrated a remarkable and unexpected ability to return to its normal and original condition after being subjected to maximum load and pressure levels according to established testing procedure. The test mattress comprised top and bottom layers of one inch thick, 1.2 pcf super soft virgin foam and a core layer of five inches thick rebonded foam of 3.2 pcf density. Comparing the "Support Firmness" characteristic after 200 and 100,000 cycles on the Cornell Testing Machine, the change of support firmness was only 6.2 percent, thereby exceeding the AH&MA Guidelines. Further after 100,000 cycles, although a 5/16 inch dimple appeared, it completely disappeared after a rest period over a week-end. The compression modulus, i.e. the initial softness and deeper firmness of the mattress is thereby controlled by the 'relative thickness and firmness of the outer layers 10, 10' and the core layer 15. A softer mattress might have a core layer 15 of approximately one to two times the thickness of one of the outer layers 10, 10' and a firmness at the lower end of the 25 percent ILD range. The compression modulus of the mattress increases as the thickness and/or firmness of the core increases. The thickness of the core 15 can satisfactorily be increased up to approximately five times that of either the top or bottom layer 10, 10' which produces an attendant increase in the compression modulus of the mattress.

Figure 2:
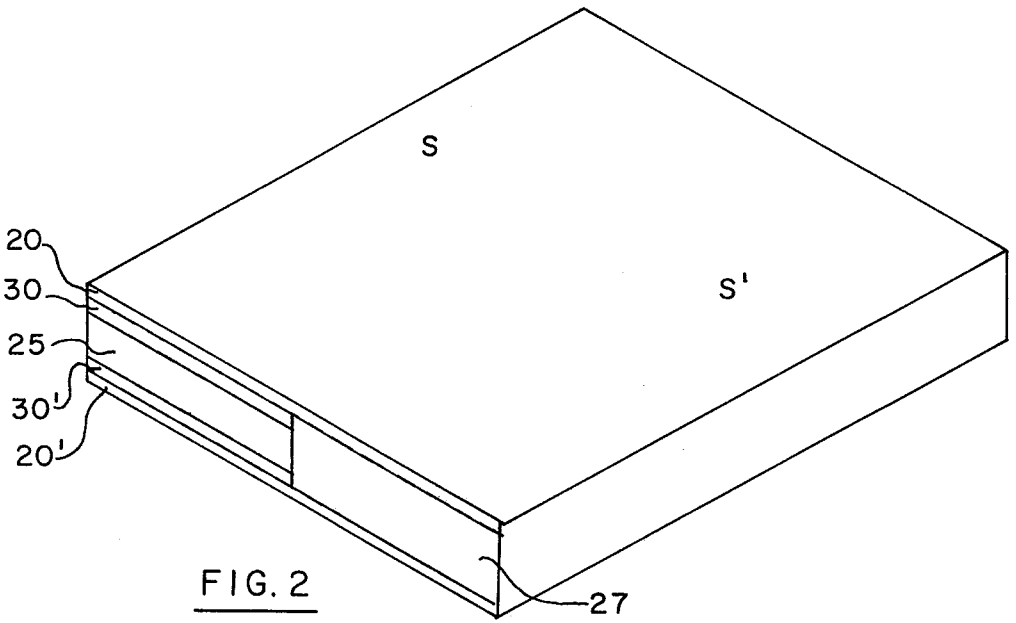
FIG. 2 is a perspective view with the end cut away illustrating a sectionalized mattress according to the present invention.

A unique mattress construction M utilizing the aforementioned cushion C is illustrated in FIG. 2 wherein two juxtaposed core sections 25, 27 of differing firmness values are covered by a unitary upper layer 20 and lower layer 20'. Core layers 25 and 27 are varied in thickness and firmness to provide a prescribed compression modulus in each of various sections of the mattress. For example the compression modulus on the left hand side of mattress M might be 4, while the right hand side compression modulus might be 6. The length of each core layer 25, 27 should be equal to the desired length of mattress M and the width of each is preferably one-half the total width, although the widths of each section could be varied if sections of differing size were desired. Outer layers 20, 20' are each a unitary sheet of soft virgin foam material equal in length and width to the desired overall length and width of mattress M. To make sections S, S' equal in thickness, section S, has two additional filler layers 30, 30' made of the same soft virgin foam as outer layers 20, 20'. Prior to lamination of outer layers 20, 20' to inner and core layers, the inner longitudinal edge of core layer 27 is permanently bonded to the adjacent edges of filler layers 30, 30' and core layer 25.

Figure 3:
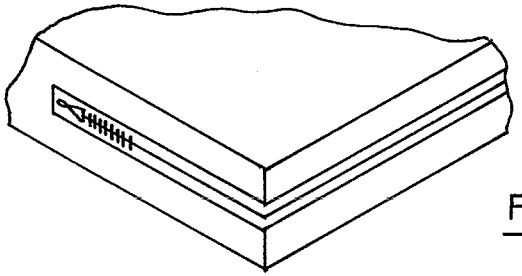
FIG. 3 is a perspective view, with parts broken away, illustrating one end of a mattress constructed in accordance with another feature of the present invention.

FIG. 3 is an illustration of a mattress construction according to the present invention complete with ticking 40 in place over the mattress. Conventional ticking is attached permanently to the mattress or cushion and cannot be removed for cleaning. In the present invention a mattress construction is provided with a ticking 40 which is preferably of a cloth covering material and entirely separate from the cushioning member and includes zipper opening 42 for selectively closing said ticking around said cushioning material. When the zipper 42 is opened, the ticking 40 can be removed from the cushioning member to facilititate cleaning of both items.

It is obvious to those skilled in the art, that various modifications might be made to the present invention as described hereinabove without departing from the scope of the invention, which is set forth in the following claims.

What is claimed is:

1. A laminated cushioning construction comprising outer layers of resilient cellular material and an inner layer of reground, bonded, resilient cellular material, the compression modulus of said cushioning construction being at least 3, said inner layer being substantially equal in length and width to said outer layers and having an thickness in the range of 1–5 times the thickness of one of said outer layers, said outer layers having a first firmness ILD value and said inner layers having a second ILD value, said second value being greater than said first value.

2. The cushioning construction according to claim 1 wherein said inner layer comprises at least two core sections joined in side-by-side relationship along corresponding longitudinal side edges, said core sections being formed of a resilient cellular material of different ILD values.

3. The mattress construction according to claim 1 wherein said outer layers each have a 25 percent ILD range of 10 to 45 lbs. and said core layer has a 25 percent ILD range of 20 to 80 lbs.

* * * * *